US006497265B2

(12) United States Patent
Davis et al.

(10) Patent No.: US 6,497,265 B2
(45) Date of Patent: Dec. 24, 2002

(54) SCREEN ASSEMBLY

(75) Inventors: Floyd C. Davis, Knoxville; Jesse T. Boring, Maryville; Charles W. Cowart; T. Glen Lowe, both of Knoxville, all of TN (US)

(73) Assignee: Jeld-Wen, Inc., Klamath Falls, OR (US)

( * ) Notice: Subject to any disclaimer, the term of this patent is extended or adjusted under 35 U.S.C. 154(b) by 0 days.

(21) Appl. No.: 09/939,096

(22) Filed: Aug. 24, 2001

(65) Prior Publication Data

US 2002/0023726 A1 Feb. 28, 2002

Related U.S. Application Data

(63) Continuation of application No. 09/707,097, filed on Nov. 6, 2000, which is a continuation of application No. 09/340,797, filed on Jun. 28, 1999, now abandoned, which is a continuation of application No. 09/094,785, filed on Jun. 15, 1998, which is a continuation of application No. 08/702,004, filed on Aug. 23, 1995, which is a continuation-in-part of application No. 08/327,303, filed on Oct. 21, 1994, now Pat. No. 5,551,501.

(51) Int. Cl.[7] ..... A47H 1/00
(52) U.S. Cl. ..... 160/87; 160/96
(58) Field of Search ..... 16/87, 90, 96, 16/97, 105, 87 R, 95 R, 96 R; 49/63; 52/202, 207

(56) References Cited

U.S. PATENT DOCUMENTS

| | | | |
|---|---|---|---|
| 1,866,882 | A | 7/1932 | Dixson |
| 1,920,614 | A | 8/1933 | Ware |
| 1,945,008 | A | 1/1934 | Voigt |
| 1,959,514 | A | 5/1934 | Zimmer |
| 1,994,205 | A | 3/1935 | Yalch |
| 2,128,405 | A | 8/1938 | Eastman |
| 2,151,295 | A | 3/1939 | Hucke |
| 2,395,742 | A | 2/1946 | Kammerer |
| 2,859,492 | A | 11/1958 | Nicoll, Jr. |
| 2,877,511 | A | 3/1959 | Viola, Jr. |
| 2,897,552 | A | 8/1959 | Kiefer |
| 2,913,046 | A | 11/1959 | Sharp et al. |
| 2,918,708 | A | 12/1959 | Sharp et al. |
| 2,944,282 | A | 7/1960 | Greco |

(List continued on next page.)

FOREIGN PATENT DOCUMENTS

| | | |
|---|---|---|
| AU | 50111 | 6/1974 |
| FR | 1420069 | 10/1965 |

OTHER PUBLICATIONS

Anderson Windows. Patio Doors; Frenchwood ® & Perma–Shield® Gliding Patio Doors, Features & Benefits, Copyright © 1996 Andersen Corporation, Bayport, Minnesota 55003, ST331, Gliding Patio Doors, pp. 1–20.

Anderson, Second Printing, Andersen A/W, Windows & Patio Doors, Frenchwood®, Gliding Patio Door, pg. 171–190.

Anderson Commercial Group, Perma–Shield® Frenchwood® Hinged Patio Doors 1990 publication, FH1–FH28.

*Primary Examiner*—Blair M. Johnson
(74) *Attorney, Agent, or Firm*—Chernoff, Vilhauer, McClung & Stenzel, LLP

(57) ABSTRACT

The invention provides a screen door system for double-hung entry doors. The screen door system comprises an inner screen assembly containing a frame member carrying a screen member, an outer screen assembly containing a frame member carrying a screen member, inner and outer upper tracks for slidably guiding the inner and outer screen assemblies along the length of the tracks and for limiting lateral movement of the inner and outer screen assemblies as the screen assemblies move longitudinally along the tracks, and a lower sill having an inner guide rail for longitudinally guiding the inner screen assembly and an outer guide rail for longitudinally guiding the outer screen assembly.

16 Claims, 5 Drawing Sheets

U.S. PATENT DOCUMENTS

| | | | |
|---|---|---|---|
| 3,136,396 | A | 6/1964 | Sullivan |
| 3,855,732 | A | 12/1974 | Sheaf |
| 3,984,954 | A | 10/1976 | Takeda |
| 4,044,504 | A | 8/1977 | Nakada |
| 4,068,433 | A | 1/1978 | Glover |
| 4,098,027 | A | 7/1978 | Crance |
| 4,319,430 | A | 3/1982 | Menard |
| 4,483,099 | A | 11/1984 | Schmidt |
| 4,538,662 | A | 9/1985 | Tomita |
| 4,573,287 | A | 3/1986 | Hagemeyer et al. |
| 5,551,501 | A | 9/1996 | Davis et al. |

SCREEN ASSEMBLY

This application is a continuation of application Ser. No. 09/707,097, filed Nov. 6, 2000, which is a continuation of application Ser. No. 09/340,797, filed Jun. 28, 1999, now abandoned, which is a continuation of application Ser. No. 09/094,785, filed Jun. 15, 1998, which is a continuation of application Ser. No. 08/702,004, filed Aug. 23, 1996, which is a continuation-in-part of application Ser. No. 08/327,303, filed Oct. 21, 1994, now U.S. Pat. No. 5,551,501.

FIELD OF THE INVENTION

The invention relates to screen door assemblies and to the upper and lower tracks for screen door assemblies for entry doors.

BACKGROUND

Within recent years, the trend in building has been away from the sliding glass doors and more toward the use of single or double, double-hung entry doors for egress to the patio area of residential buildings. As with the sliding glass patio doors, there is sometimes associated with the single or double entry door a single screen door which will allow the door to be opened for fresh air circulation yet prevent insects or dirt from entering the building. The single screen door may be hinged to swing open for egress from the building, or the single screen door may be supported in a track for sliding to the opened or closed position. Even where double entry doors are used, there typically is only one screen door assembly.

An object of the invention therefore is to provide a multiple screen assembly system for a double entry door.

Another object of the invention is to provide an economic means for assembling a double screen door system.

Still another object of the invention is to provide a double screen door assembly which can be readily affixed adjacent an entry door frame.

Yet another object of the invention is to provide an upper double track assembly for use in slidably supporting a double screen door.

Another object of the invention is to provide a lower double track assembly for use with a double screen door system.

Still another object of the invention is to provide a double screen door assembly wherein the screen doors are easily removable thereby providing unobstructed access for full use of a double entry door.

These and other objects of the invention will become evident from the ensuing description and appended claims.

SUMMARY OF THE INVENTION

In one embodiment, the invention provides a screen system for entry doors. The screen system comprises an inner generally rectangular screen door having spaced apart elongate parallel upper and lower frame members of substantially equal length and an outer generally rectangular screen door having spaced apart elongate parallel upper and lower frame members of substantially equal length. Each of the screen doors has a width corresponding generally to the length of its corresponding upper and lower frame members. The screen system also contains an upper screen door support member for attachment to a house adjacent a header of at last a double door exterior door system and a lower screen support member for attachment to a house adjacent a sill of the exterior door system in spaced apart relation to the upper screen door support member. A track guide system connects the inner and outer screen doors between the upper and lower screen door support members for translational movement in space-apart overlapping planes generally parallel to the screen doors in a direction substantially parallel to the length of the screen door support members.

In another embodiment, the invention provides an upper track for slidably guiding screen assemblies. The upper track comprises a first U-shaped channel having a first channel base member, a second U-shaped channel having a second channel base member, and a first side channel member common to and attached to the first and second U-shaped channels. The first and second base member of the U-shaped channels are offset relative to one another so that the first and second base members lie in different substantially parallel planes. Each U-shaped channel further contains a second side channel member on an opposing side of the channel base member from the first side channel member having a dimension sufficient to limit the lateral movement of the screen assemblies as the screen assemblies are moved in a direction substantially parallel to the U-shaped channels.

In yet another embodiment, the invention provides a screen system for double-hung entry doors. The screen system comprises an inner screen assembly containing a frame having upper and lower horizontal frame members and first and second vertical frame members carrying a screen; an outer screen assembly containing a frame having upper and lower horizontal frame members and first and second vertical frame members carrying a screen; and upper inner and outer longitudinal screen guides attached to a building adjacent the entry doors for slidably engaging a portion of the upper horizontal frame member of each of the inner and outer screen assemblies. Each of the inner and outer screen guides contain an elongate planar horizontal member having first and second edges, a first planar vertical member adjacent the first edge and a second planar vertical member adjacent the second edge wherein the second planar vertical member is common to both the inner and outer screen guides. Preferably, the elongate planar horizontal members lie in spaced apart substantially parallel planes. The outer screen guide further contains an upstanding rigid elongate member substantially centered between the first and second planar vertical members for limiting the lateral movement of the outer screen assembly when slidably positioning the outer screen longitudinally along the outer guide. The screen system also contains a lower sill attached adjacent a sill of the double-hung entry doors having an inner guide rail for engaging the lower horizontal frame member of the inner screen assembly and for limiting lateral movement of the inner screen assembly and an outer guide rail for engaging the lower horizontal frame member of the outer screen assembly and for limiting lateral movement of the outer screen assembly when slidably adjusting the outer screen.

Another embodiment of the invention provides a threshold track assembly for slidably guiding a screen door of a double screen door assembly. The threshold track assembly is attached to the threshold of an entry door having a projecting handle and comprises a threshold baseplate for attachment to the threshold, and inner and outer spaced apart, upstanding, substantially parallel tracks connected to the baseplate. The tracks extend substantially the entire length of the baseplate and a threshold attachment means. The space-apart tracks are positioned on the baseplate such that when the baseplate is attached to the threshold using the threshold attachment means, the outer screen door supported on the outer track is spaced from the entry door sufficient to enable at least the outer screen door to clear the door handle when the outer screen door is slid along the inner track.

The invention therefore provides a simple cost-effective system for providing a double screen assembly for double entry doors. Furthermore, the screen system of the invention has features which reduce or avoid the interference between the movable screen door and the handle of the entry door when slidably adjusting the position of the screen door.

Because the screens are easily removable from the double screen assembly, and there is no need for a center post for sealing between the screen doors, full unobstructed access to the double entry doors is available when the screen doors are removed. Hence, large objects may be moved through the entry doors when the screen doors are removed from their guides and guide rails.

SUMMARY OF THE DRAWINGS

Additional features of the invention will become known from the following detailed description of preferred embodiments when considered in conjunction with the accompanying drawings in which.

DETAILED DESCRIPTION OF THE INVENTION

Figure 1:
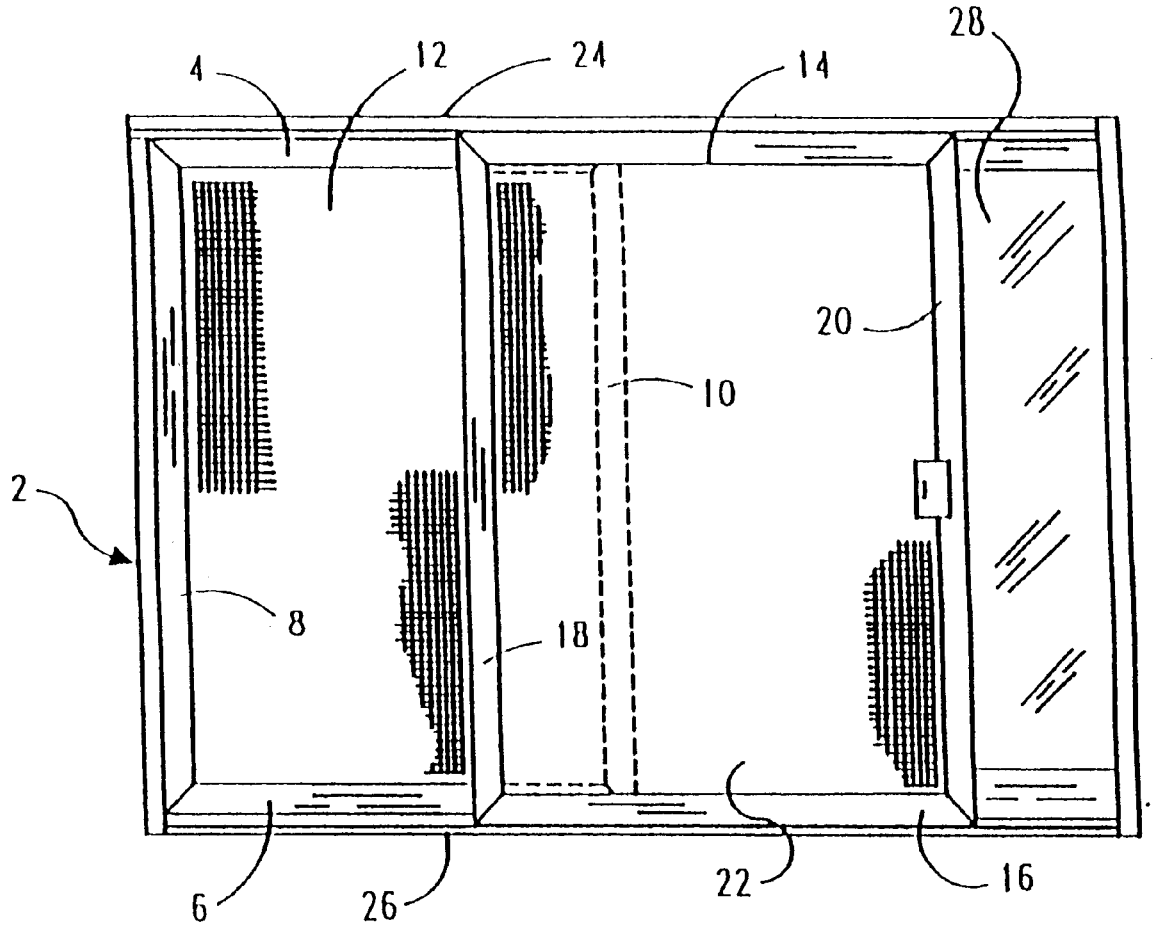
FIG. 1 is a elevational view, not to scale of the double screen door assembly of the invention illustrating the overall arrangement of the double screen doors.

The overall arrangement of a double screen system according to the invention is illustrated in FIG. 1. As shown in FIG. 1, a double screen system 2 comprises an inner screen assembly containing upper and lower, horizontal frame members 4 and 6 first and second vertical frame members 8 and 10 carrying a screen member 12 and an outer screen assembly containing upper and lower horizontal frame members 14 and 16 and first and second vertical frame members 18 and 20 carrying a screen member 22. The outer screen assembly moves longitudinally along upper guide track 24 and lower guide rail 26. The entire screen assembly 2 is positioned relative to an entry door assembly 28 such that it is fixedly attached to the building adjacent to and preferably within an outside perimeter of the entry door frame.

An important feature of the invention is the upper guide track 24 illustrated in FIGS. 2A through 2D and FIG. 5. The track 24 preferably contains two channels, an inner channel 30 and an outer channel 32 defining inner and outer upper guide tracks 46 and 44 for slidably engaging upper horizontal frame members 4 and 14 of the inner and outer screen assemblies (FIG. 1).

Each of the channels 30 and 32 is provided by elongate substantially planar horizontal members 34 and 36 and elongate substantially planar vertical members 38, 40 and 42. It is preferred that planar vertical member 40 be common to inner and outer channels 30 and 32, however this is not required. In the alternative, an additional planar vertical member adjacent planar vertical member 40 may be provided to define the inside wall of channel 30 or 32. It is also preferred that the inner and outer channels be offset vertically relative to one another such that horizontal member 34 is offset a vertical distance V from horizontal member 36 and each horizontal member lies in substantially separate parallel planes. The vertical distance V is preferably between about 0.3 to about 1.0 inches (about 0.8 cm to about 2.54 cm). Most preferably, the vertical distance V is about 0.5 inches (about 1.3 cm). The vertical distance V is selected such that the upper guide track 24 will fit flush against the head jamb and brick mold of a typical entry door frame.

The overall width W of the upper guide track is preferably between about 1.3 and about 2 inches (about 3.3 cm and about 5 cm), most preferably about 1.4 inches (3.5 cm). The width of the individual channels 30 and 32 should be sufficient to allow for movement of the screen assembles with a minimum amount of friction between the vertical members 38, 40 and 42 and the horizontal frame members 4 and 14 of the screen assemblies. The lengths of vertical members 38, 40 and 42 are not critical to the invention provided the length is sufficient to limit the lateral movement of the inner and outer screen assemblies perpendicular to the sliding planes of the screen assemblies which are oriented parallel to the length of the upper guide track 24.

In a particularly preferred embodiment, the upper guide track 24 also contains a depending rigid elongate member 44 extending the length of the channel and substantially centered between planar vertical members 40 and 42 of the outer channel 32. It is preferred that at least the outer guide channel 32 contain a depending rigid elongate member 44, however, both inner and outer channels may contain depending rigid members 44 and 46. The height II of each member 44 or 46 is preferably within the range of from about 0.2 to about 0.4 inches (about 0.5 to about 1.0 cm). As further illustrated in FIG. 3, the rigid members 44 and 46 assist in guiding the inner and outer screen assemblies by engaging wheels 48 of the inner and outer screen assemblies to limit the lateral movement of the screen assemblies perpendicular to their sliding planes, thereby reducing the amount of friction between upper horizontal frames 4 and 14 and vertical planar members 38, 40, and 42.

Figure 2A:
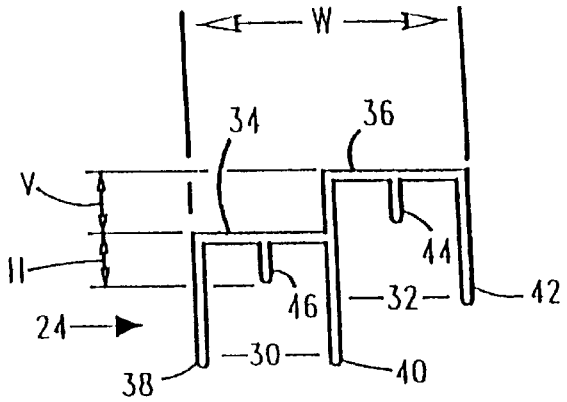
FIGS. 2A and 2B are cross-sectional views of typical dual upper channels of the invention for guiding the inner and outer screen assemblies.
Figure 2B:
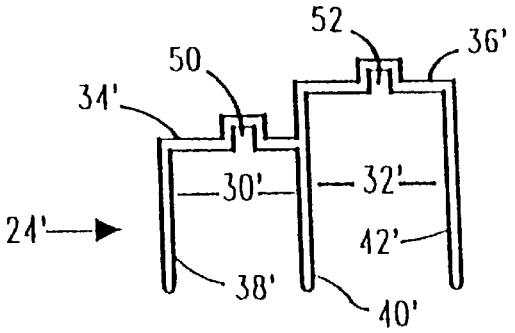

It will be recognized that the upper guide track may have other configurations which functionally limit the lateral movement of the screen assemblies perpendicular to their sliding planes, while providing suitable means for slidably adjusting the screen assemblies. Accordingly, instead of upright members 44 and 46, channels 30 and 32' of guide track 24' may have indentions 50 and 52 as illustrated in FIG. 2B. Indentions 50 and 52 may be wide enough to accept wheels attached to the upper horizontal frame members 4 and 14 of the inner and outer screen assemblies or may only be sufficiently wide to accept a relatively narrow metal guide pending from the upper horizontal frame members of the screen assemblies.

Figure 2D:
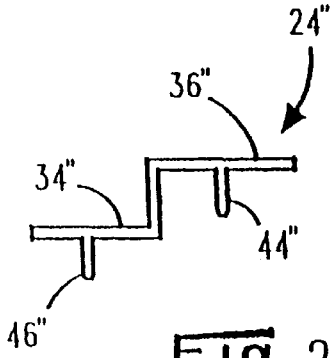
FIG. 2D is an cross-sectional view of an alternative dual upper screen guide.
Figure 2C:
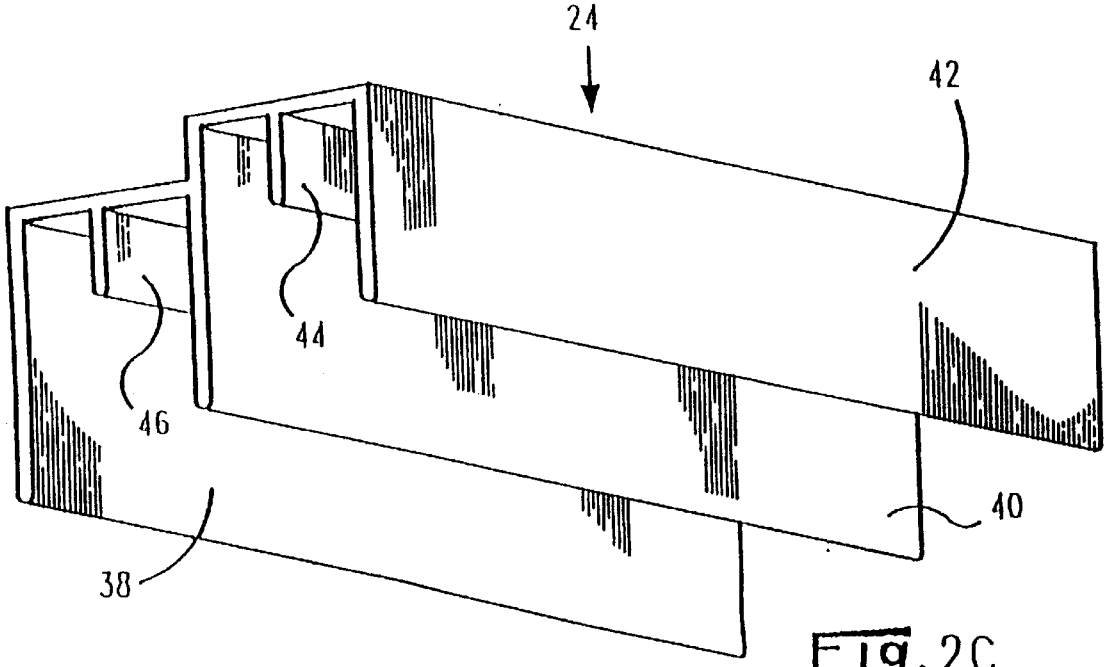
FIG. 2C is a perspective view of a dual upper guide channel of the invention.

FIG. 2D is yet another configuration for upper guide track 24". In this figure, substantially planar horizontal members 34" and 36" contain depending members 44" and 46" extending the length of the tracks. These members 44" and 46" engage wheels 48 in the upper frame members 4 and 14 of the inner and outer screen assemblies to guide the screen assemblies during movement of the inner and outer screen assemblies in a direction substantially parallel to the length of upper guide track 24".

Figure 5:
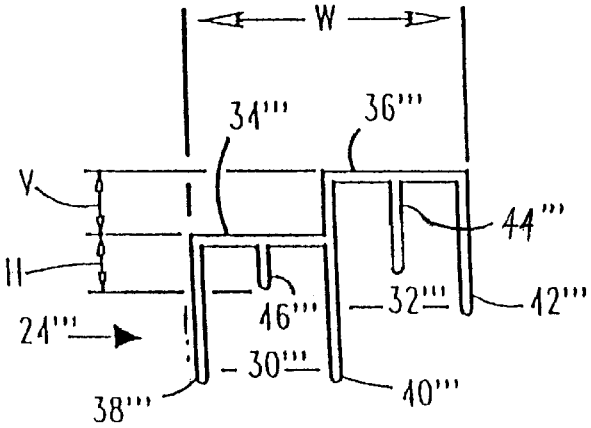
FIG. 5 is a cross-sectional view of another upper guide channel of the invention.

FIG. 5 is an illustration of another configuration of upper guide track 24'''. In FIG. 5, channels 30''' and 32''' are offset so that planar members 34''' and 36''' lie in substantially separate parallel planes and depending member 44''' of channel 32''' attached to planar member 36''' is longer than the depending member 46''' of channel 30''' attached to planar member 34'''. By extending the length of member 44''', inner and outer screen doors of substantially the same size may be used with the upper guide track 24''' in a double screen door assembly. If desired, vertical planar member 42''' of channel 32''' may also be extended so that it terminates even with the edges of vertical planar members 38''' and 40''' to thereby assist in retaining an outer screen assembly within channel 32'''.

While channels 30 and 32 of the various embodiments of upper guide track 24 may be formed by any number of conventional means such as welding, tacking, riveting, bolting and the like individual channels to one another, it is preferred that the guide track be a single extruded form containing inner and outer channels 30 and 32 and preferably upright member 44 and 46. The extruded track may be formed from any of the metals generally used in the building track such as aluminum, mild steel, galvanized steel, and the like. In the alternative, the upper guide track may be molded or extruded from various plastic materials, such as polyolefins, high impact polyolefins, polyamides, phenolics, and the like.

Figure 3:
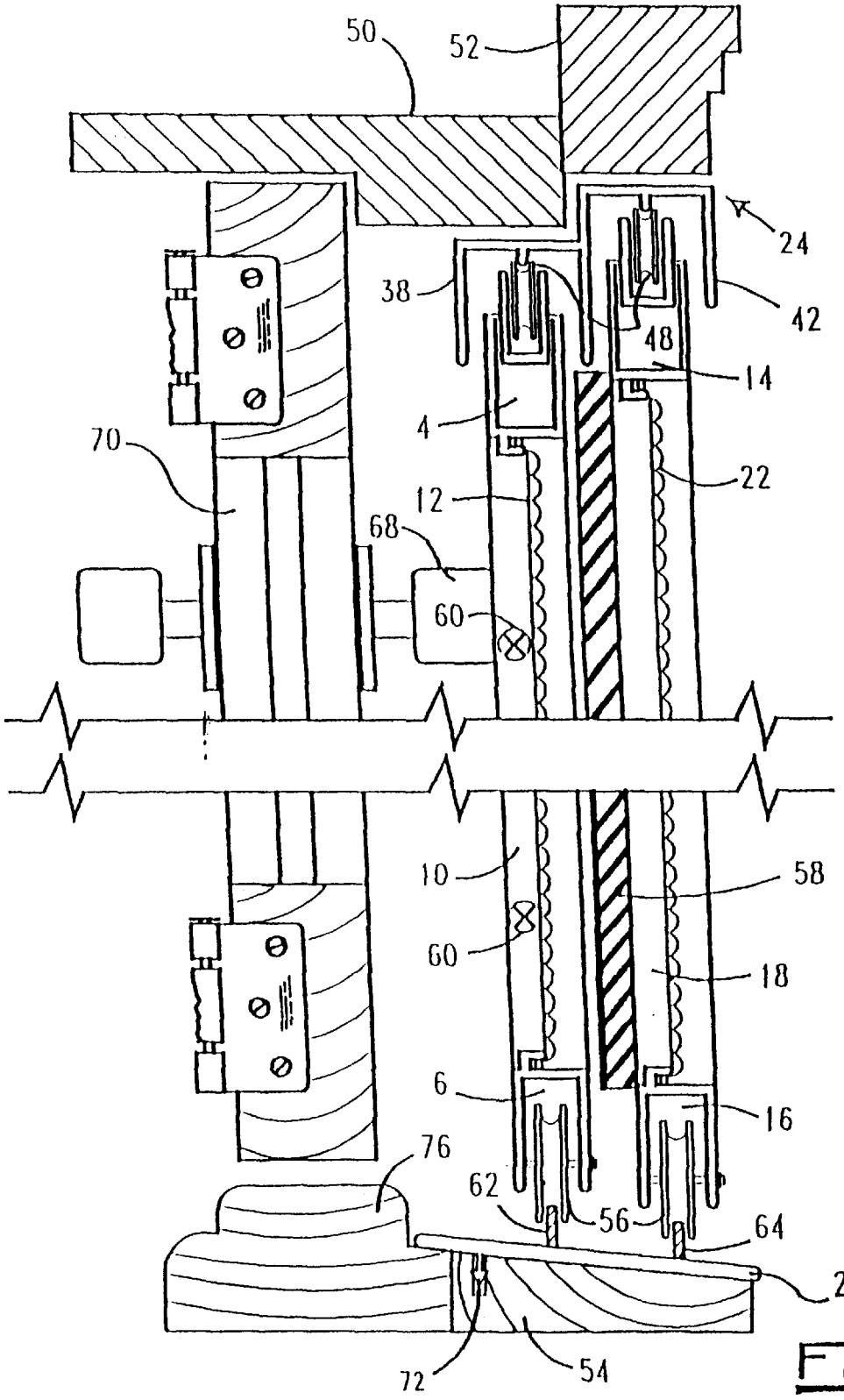
FIG. 3 is a partial vertical sectional view illustrating the relative positions of the inner and outer screen assemblies and a double entry door.

FIG. 3 is a cross-sectional partial elevational view of the double screen assembly of the invention. The screen assembly may be affixed to a double door frame by attaching the upper guide track 24 to the head jamb 50 and brick mold 52 of a door frame and attaching a lower sill 2644 to the sill area 54 of the entry door passage way. The screen assemblies are then positioned to engage the upper guide track 24 and lower sill 26 of the double screen assembly.

Means for attaching the upper guide track 24 to the entry door head jamb 50 and brick mold 52 of the entry door frame include bolting, nailing, gluing, and the like. In an alternative, the upper guide track 24 may be made of plastic or metal and may contain barbs or appendages directed upward from planar horizontal members 34 and 36, which appendages are designed to mate with a corresponding groove in the head jamb 50 and brick mold 52. Other means for attaching the guide track 24 to the entry door area are within the ordinary skill of those in the art.

In order to slidably shift the inner and outer screen assemblies, each screen assembly preferably contains a pair of longitudinally spaced apart wheels 48 mounted in the upper horizontal frame members 4 and 14 and longitudinally spaced wheels 56 mounted in the lower horizontal frame members 6 and 16. Wheels 48 are guided within channels 30 and 32 preferably by upright rigid members 44 and 46 (FIG. 2A) so as to limit the lateral movement of the screen assemblies particularly where friction between the horizontal frame members 4 and 14 and the vertical members 38, 40 and 42 of channels 30 and 32 (FIG. 2) might occur.

In a particularly preferred embodiment, first vertical frame member 18 of the outer screen assembly contains a pendant resilient, weatherproof elongate member 58 projecting inwardly toward the inner screen assembly. Resilient elongate member 58 is useful for wiping the outer surface of the inner screen 12 (FIG. 1) when slidably adjusting the outer screen assembly. The resilient elongate member 58 may also seal between adjacent second vertical frame members 10 and 18 (FIG. 1) of the inner and outer screen assemblies which overlap each other when the screens are in their fully closed position relative to the entry door. In the alternative, the resilient member 58 may depend outwardly from the second vertical frame member 10 (FIG. 1) of the inner screen assembly so as to wipe an inner surface of outer screen 22. Likewise, the resilient elongate member 58 when attached to the inner screen assembly may seal between adjacent vertical frame members 10 and 18 (FIG. 1) of the inner and outer screen assemblies which overlap each other when the screens are in their fully closed position relative to the entry door. A resilient elongate member 58 may be affixed to the second vertical frame members (10 and 18) of both the inner and outer screen assemblies.

The resilient elongate member 58 may be made of any suitable elastomeric material such as natural and synthetic rubbers and various plastic materials such as polypropylene, nylon, polyvinyl chloride, and the like. Attachment of the elongate member to vertical frame members 10 and/or 18 may be made by adhesives or screws, or the elongate member may contain a bead or molded lips for slidably attaching the elongate member to the vertical frame members.

In a preferred embodiment, only the outer screen assembly is slidably adjustable between the vertical door frame members and may abut either door frame vertical member in the open or closed positions. The inner screen assembly may be abutted to and affixed to the entry door frame by holding screws 60 or any other well known attachment means.

Figure 4:
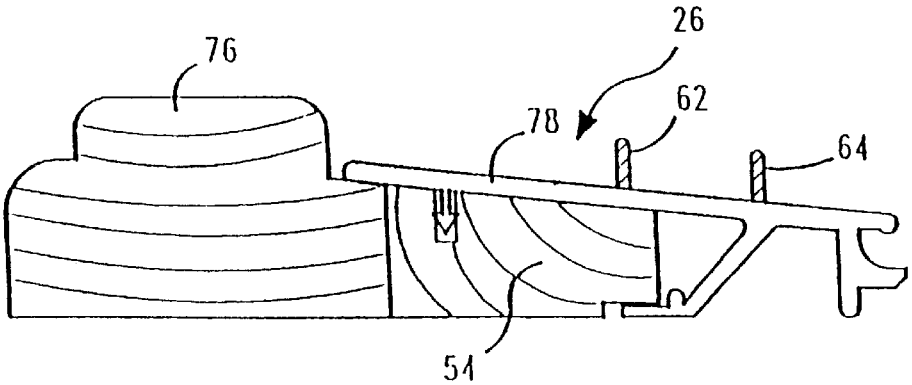
FIG. 4 is a cross-sectional view of a typical sill assembly for the double screen system.

FIG. 4 illustrates the features of a lower sill 26 for use with the double screen system of this invention. The lower sill 26 is affixed to the threshold 54 of the entry door and contains preferably integral, upstanding inner guide rail 62 and outer guide rail 64 for longitudinally guiding the inner and outer screen assemblies for sliding or rolling movement as described above. The guide rails are positioned relative to one another so that they engage the lower horizontal frame members 6 and 16 of the inner and outer screen assemblies and support the screen assemblies in substantially vertical orientations in substantially parallel spaced apart planes when the upper horizontal frame members 4 and 14 (FIG. 1) are engaged by upper track 24. Guide rails 62 and 64 also provide for longitudinal sliding or rolling movement of inner and outer screen assemblies whereby the lateral movement perpendicular to the direction of travel along the guide rails of the screen assemblies is limited.

In FIG. 4, the door threshold 54 extends substantially the entire length of the baseplate 78 of the lower sill 26 so that is supports the baseplate 78 at least under guide rails 62 and 64 thereof. Support of the baseplate 78 is important particularly when the baseplate is made of a thin somewhat flexible material rather than a thick rigid material because the weight of the screen assemblies may cause undesirable deflection of the baseplate 78 and guide rails 62 and 64 from their operative positions thus interfering with slidably adjusting the screen assemblies relative to the entry door. Door threshold 54 also permits the guide rails 62 and 64 to be positioned a suitable distance from the entry door so that interference between the outer screen assembly and door knob is eliminated as the outer screen assembly is slidably adjusted along its guide rail 64.

As illustrated in FIG. 3, the upper guide track and lower sill provide for movement of the outer screen assembly even where the door handle 68 of an entry door 70 protrudes a distance that prevents full movement of the inner screen assembly. That is, the horizontal distance between rail 64 and the door frame 76 is sufficient to enable the outer screen assembly to slide past and clear the outmost protuberance of the door knob 68. This advantage is achieved with the use of the double screen assembly, the resilient elongate member 68 for sealing between adjacent vertical frame members, and the configuration of the upper track 24 and lower sill 26.

It is therefore preferred that the guide rail 64 of the lower sill 26 be spaced from the entry door frame 76 a distance of at least about 3.5 inches, most preferably about 4 inches, and that guide rail 62 be spaced from guide rail 64 a distance of about 0.5 to about 1.25 inches, most preferably about 0.75 inches. The entire length of the lower sill may be about 4 to about 4.5 inches.

A screen system having an upper guide track and a lower guide rail which allows the inner and outer screen assemblies to be positioned within an entry door frame so that the inner and outer screen assemblies are slidably positioned near one another provides a narrow space between the overlapping vertical frame members of the screen assemblies which can be sealed with the resilient elongate sealing member. Hence, the screen assemblies need not be positioned in close proximity to the entry doors 70 since a seal need not be effected between the entry door or door frame and the screen assemblies.

Figure 6:
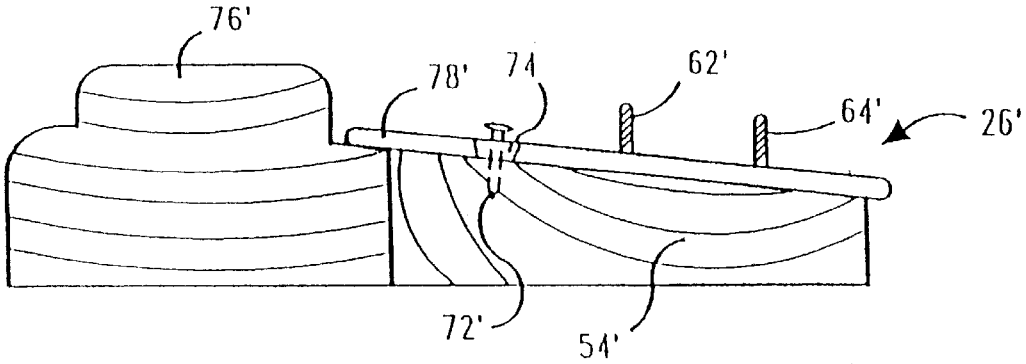
FIG. 6 is cross-sectional view of a another double track sill assembly for a double screen system of the invention.
Figure 7:
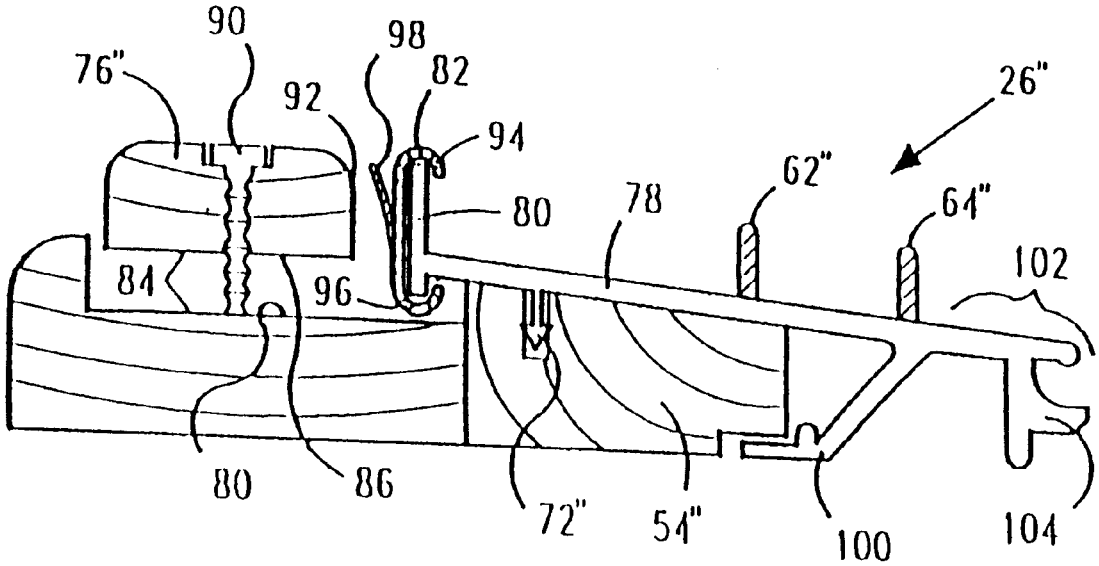
FIG. 7 is yet another cross-sectional view of another double track sill assembly of the invention.

FIGS. 6 and 7 are cross-sectional views of alternative embodiments of lower sills 26' and 26" of the invention. The lower sill 26' contains a first upstanding guide track 62' and a second spaced apart upstanding guide track 64'. As illustrated in FIG. 6, the sill 26' also contains an attachment means 72' which comprises a screw or nail and one or more apertures 74' in the lower sill 26' for insertion therethrough of the screw or nail for fixedly attaching the sill 26' to a entry door threshold 54'. In the alternative, the attachment means 72' may comprise an adhesive or integrally extruded barb (72", FIG. 7) for fixedly attaching the sill to an entry door threshold.

For use in retrofitting an entry door with the double screen door system of the invention, the entry door threshold 54" may be inserted or otherwise extended from the door frame 76' so that it extends and supports the baseplate 78' at least under guide rails 62' and 64'. In the alternative, baseplate 78' may contain a support member 104 (FIG. 7) attached to the baseplate 78' at the distal end 102 thereof for supporting the baseplate 78' in the absence of an extension of the threshold 54' to the distal end 102 of the baseplate 78'. As described with reference to FIG. 4, door threshold 54' permits the guide rails 62' and 64' to be spaced a suitable distance from the entry door frame 76' so that interference between the outer screen assembly and door handle 68 (FIG. 3) is eliminated as the outer screen assembly is slidably adjusted along its guide rail 64'. Likewise, the distance between guide tracks 62' and 64' is sufficient to provide free movement of the screen assemblies past one another, yet sufficiently close to provide adequate sealing between a vertical frame member of each screen assembly when a resilient elongate member 58 is attached to a vertical frame member of one of the screens.

FIG. 7 illustrates another lower sill 26" for attachment adjacent entry door threshold 54". The lower sill 26" comprises a cast, molded or extruded baseplate 78", preferably provided by an aluminum extrusion containing an inner guide rail 62" attached to the baseplate for engaging a lower horizontal frame member of an inner screen assembly and an outer guide rail 64" for slidably guiding a lower horizontal frame member of an outer screen assembly. Guide rails 62" and 64" are spaced apart a sufficient distance to provide free movement of screen assemblies past one another, yet sufficiently close to provide adequate sealing between a vertical frame member of each screen assembly when a resilient elongate member 58 is attached to a vertical frame member of one of the screens.

The lower sill 26" also contains an attachment means 72" for fixedly attaching the sill 26" to an entry door threshold. The attachment 72" may be a screw, nail or barb which is driven or pressed into door threshold 54" during assembly of the sill 26" to the threshold 54".

The lower sill 54" may further comprise an upstanding integral rigid lip member 80 adjacent one end of the sill assembly 26" closet o the entry door frame 76". The lip member 80 preferably has a resilient weather proof elongate sealing member 82 slidably attached to the lip member 80 or adhesively affixed the lip member 80 for sealing between the lower sill 26" and an entry door frame 76" to limit entry of water into a building. While the invention is not intended to be limited thereto, the lip member 80 and resilient member 82 are particularly useful with a conventional adjustable door frame 76". The adjustable frame 76" may be moved upwardly or downwardly so that a distance 84 between the lower portion 86 of door frame 76" and upper portion 88 of threshold 54" may be reduced or increased to seal against the bottom edge of a building opening entry door. Adjustment screw 90 may be used to move the frame member 76" up or down with respect to the threshold 54" and the lower edge of the building door.

During the upward and downward movement of frame member 76", edge 92 of frame member abuts sealing member 82 thereby sealing between the lower sill 26" and the adjustable frame member 76". Sealing member 82 may be adhesively attached to lip member 80 or sealing member 82 may have molded or extruded upper and lower lips, 94 and 96 respectively, which engage lip member 80 for slidably attaching sealing member 82 to lip member 80 so that sealing member 82 is adjacent frame member 76" along edge 92 thereof and lip member 80. In order to improve the sealing effect of sealing member 82, member 82 may contain pendent flexible member 98 for abutting frame member 76" along edge 92 during movement of frame member 76".

While the guide rails 62' or 62" and 64' or 64" of sills 26' and 26" are typically the same height, they may also be different heights. For example, guide rails 64' or 64" may be taller than guide rail 62' or 62" because the sill 26' or 26" is typically installed on a doorway threshold with a slope so that water will drain from the sill away from the doorway. By making guide rail 64' or 64" taller so that the top of the guide rails 62' or 62" and 64' or 64" lie in the same horizontal plane, the same size screen door may be used as an inner and outer screen door. Apertures (not shown) may also be provided in guide rails 62' or 62" and 64' or 64" along their bases for drainage of water away from the entry door between the guide rail so that the rails 62' or 62" and 64' or 64" do not act as dams and pooling of water therebehind is minimized.

Other features of sill 26" include a clamp member 100 which may be integrally molded or extruded with sill 26" for rigidly attaching the sill 26" to the threshold 54" and for supporting the distal portion 102 of sill 26". Likewise, support member 104 may be molded, extruded or fixedly attached to sill 26" on the distal end thereof opposite the frame member 76" for supporting the distal portion 102 of the sill 26".

The entire lower sill 26' or 26" may be made of a resilient materials such as metal or plastic and thus may be molded, extruded melt formed, or otherwise shaped to contain at least upstanding guide tracks 62' or 62" and 64' or 64". The thickness of the lower sill 26' or 26" is not critical to the invention provided it is of sufficient thickness to be durable and rigid so that guide tracks 62' or 62" and 64' or 64" remain substantially vertical and inflexible and resist separation of the tracks from the sill when impacted by a hard or heavy object.

While the foregoing description relates in general to double screens and double entry door, the invention can readily be adapted for use with more than two screens and more than two entry doors. Furthermore, while there is no particular commercial advantage to the use of the screen system as described with a single entry door, such use is also contemplated by the invention.

Having described and illustrated the invention in its preferred embodiments, it will be recognized that variations of the present invention by those skilled in the art are within the spirit and scope of the appended claims.

What is claimed is:

1. A door assembly comprising:

a first and a second hinged entry door, said hinged entry doors being substantially coplanar when in a closed position, said first hinged entry door further having an outwardly projecting handle, an inner and an outer screen door, said inner screen door having a height which is less than that of the outer screen door, and a track assembly for slidably guiding said inner and outer screen doors, said track assembly comprising a threshold baseplate for attachment to a doorway threshold, inner and outer spaced apart substantially parallel, upstanding tracks connected to the baseplate for engagably supporting the inner and outer screen doors, respectively, which tracks traverse substantially the entire length of the baseplate, said inner track further being vertically offset above the outer track to accommodate the height of the inner screen door and a threshold attachment means, wherein the spaced apart tracks are positioned on the baseplate such that when the baseplate is attached to the threshold using the threshold attachment means, the inner screen door supported on the inner track is spaced from the door sufficiently to enable at least one screen door to clear the door handle when the screen door is slid along the track.

2. The door assembly of claim 1 wherein the attachment means comprises one or more apertures in the assembly for fixedly attaching the assembly to a doorway threshold using a screw or nail through the one or more apertures.

3. The door assembly of claim 1 wherein the baseplate is an extruded aluminum baseplate.

4. The door assembly of claim 1 wherein the upstanding tracks are of substantially equal height from the baseplate.

5. The door assembly of claim 1 wherein the inner track is spaced from the first entry door sufficiently to enable the inner screen door to clear the door handle when the inner screen door is slid along the inner track.

6. The door assembly of claim 1 wherein the upstanding tracks contain one or more drainage apertures therein.

7. The door assembly of claim 1 wherein the inner and outer tracks are substantially the same height.

8. The door assembly of claim 1 wherein the door assembly further comprises a side frame member and the inner screen door is fixedly attached to the side frame member.

9. A door assembly comprising:

a first and a second hinged entry door, said hinged entry doors being substantially coplanar when in a closed position, said first hinged entry door further having an outwardly projecting handle, an inner and an outer screen door, said inner screen door having a height which is less than that of the outer screen assembly, and an upper track for slidably guiding the inner and outer screen doors, said upper track including a first U-shaped channel having a first channel base member, a second U-shaped channel having a second channel base member, and a first side channel member common to said first and second U-shaped channels and attached to said first and second channel base members, wherein said first and second base members are offset relative to one another so that the first and second base members lie in different substantially parallel planes and wherein each U-shaped channel contains a second side channel member on an opposing side of the channel base member from the first side channel member, said second side channel members having respective dimensions sufficient to limit lateral movement of the screen assemblies as the screen assemblies are moved in a direction substantially parallel to the U-shaped channels.

10. The door assembly of claim 9 wherein the door assembly further comprises a side frame member and the inner screen door is fixedly attached to the side frame member.

11. The door assembly of claim 9 further comprising an upstanding rigid elongate member substantially centered between said first and second side channel members of each channel for slidably guiding an inner and an outer screen assembly.

12. The door assembly of claim 11 wherein the upstanding rigid elongate member has a height within the range of about 0.2 to about 0.4 inches (about 0.5 to about 1.0 cm).

13. The door assembly of claim 9, said upper track having an overall width of no greater than about 2 inches (about 5 cm).

14. The door assembly of claim 9 wherein said first and second base members are offset about 0.5 inches (about 1.3 cm) or more relative to one another.

15. A door assembly comprising:

a first and a second hinged entry door, said hinged entry doors being substantially coplanar when in a closed position, said first hinged entry door further having an outwardly projecting handle, an inner and an outer screen door, said inner screen door having a height which is less than that of the outer screen door, a track assembly for slidably guiding said inner and outer screen doors, said track assembly comprising a threshold baseplate for attachment to a doorway threshold, a threshold attachment means, and inner and outer spaced apart substantially parallel, upstanding tracks connected to the baseplate for engagably supporting the inner and outer screen doors, respectively, which tracks traverse substantially the entire length of the baseplate, said inner track further being vertically offset above the outer track to accommodate the height of the inner screen door, wherein the spaced apart tracks are positioned on the baseplate such that when the baseplate is attached to the threshold using the threshold attachment means, the inner screen door supported on the inner track is spaced from the door sufficiently to enable at least one screen door to clear the door handle when the screen door is slid along the track, and an upper track for slidably guiding the inner and outer screen doors, said assembly including a first U-shaped channel having a first channel base member, a second U-shaped channel having a second channel base member, and a first side channel member common to said first and second U-shaped channels and attached to said first and second channel base members, wherein said first and second base members are offset relative to one another so that the first and second base members lie in different substantially parallel planes and wherein each U-shaped channel contains a second side channel member on an opposing side of the channel base member from the first side channel member, said second side channel members having respective dimensions sufficient to limit lateral movement of the screen assemblies as the screen assemblies are moved in a direction substantially parallel to the U-shaped channels.

16. The door assembly of claim 15 wherein the door assembly further comprises a side frame member and the inner screen door is fixedly attached to the side frame member.

* * * * *